US006578643B2

(12) United States Patent
Izumisawa

(10) Patent No.: US 6,578,643 B2
(45) Date of Patent: Jun. 17, 2003

(54) PNEUMATIC RATCHET DRIVE WRENCH

(75) Inventor: Osamu Izumisawa, Tokyo (JP)

(73) Assignee: S.P. Air Kabusiki Kaisha, Nagano (JP)

( * ) Notice: Subject to any disclaimer, the term of this patent is extended or adjusted under 35 U.S.C. 154(b) by 0 days.

(21) Appl. No.: 09/909,343

(22) Filed: Jul. 19, 2001

(65) Prior Publication Data

US 2003/0024715 A1 Feb. 6, 2003

(51) Int. Cl.[7] ..... B25B 13/46

(52) U.S. Cl. ..... 173/47; 173/104; 173/110; 173/178; 173/53; 173/55; 173/168

(58) Field of Search ..... 173/104, 47, 110, 173/178, 53, 55, 168; 81/57.39, 58, 63.1, 60, 61, 62; 192/93.1

(56) References Cited

U.S. PATENT DOCUMENTS

| | | | | |
|---|---|---|---|---|
| 2,264,012 A | | 11/1941 | Wasson | |
| 2,712,256 A | | 7/1955 | Fish | |
| 3,270,595 A | | 9/1966 | Hall et al. | |
| 3,608,683 A | * | 9/1971 | Fujisawa | 192/217.4 |
| 4,259,883 A | * | 4/1981 | Carlson | 81/60 |
| 4,346,630 A | | 8/1982 | Hanson | |
| 4,722,252 A | | 2/1988 | Fulcher et al. | |
| 4,993,288 A | | 2/1991 | Anderson et al. | |
| 5,450,773 A | | 9/1995 | Kim et al. | |
| 5,535,646 A | | 7/1996 | Allen et al. | |
| 5,738,192 A | | 4/1998 | Miner | |
| 6,308,594 B1 | * | 10/2001 | Cheng | 81/62 |

* cited by examiner

*Primary Examiner*—Stephen F. Gerrity
*Assistant Examiner*—Brian D Nash
(74) *Attorney, Agent, or Firm*—Senniger, Powers, Leavitt & Roedel

(57) ABSTRACT

A pneumatic ratchet drive wrench of the present invention includes a pair of single springs that each bias a corresponding pawl into engagement with an output member and inhibit counter-rotation of the output member opposite the corresponding pawl. The pawl and spring construction allows the wrench head to be smaller than conventional pneumatic ratchet drive wrenches, providing better wrench access into small spaces. The spring is inexpensively formed as one piece of spring wire having independent spring coils for biasing the pawl and inhibiting counter-rotation of the output member.

19 Claims, 6 Drawing Sheets

PNEUMATIC RATCHET DRIVE WRENCH

BACKGROUND OF THE INVENTION

This invention generally relates to pneumatic ratchet drive wrenches and more particularly to a pneumatic ratchet drive wrench having a single spring for both biasing a pawl into engagement with an output member and inhibiting counter-rotation of the output member.

The invention is especially concerned with a powered wrench that rotates an output member with a socket for turning a fastener element such as a bolt or a nut. Wrenches of this type are useful in automotive repair and industrial applications. Conventionally, pneumatic ratchet drive wrenches comprise an air motor for powering the wrench, an internal ratchet mechanism for transferring motion of the motor and an output member for transmitting such motion to a workpiece. Put simply, the internal ratchet mechanism typically includes a rotating offset shaft spinning with the air motor that in turn pivots a rocker having pawls attached which repeatedly engage a set of teeth on the output member, causing the member to rotate in a desired direction. During each rotation of the air motor, the output member is rotated a fraction of a revolution. By repeatedly engaging the output member and rotating it only a short distance, great mechanical advantage is obtained and the high-speed rotation of the air motor is readily converted to a high-torque, yet more slowly rotating, output member. These advantages are well understood in the relevant art.

Despite the simplicity of the concept behind a pneumatic ratchet drive wrench, the internal ratchet mechanisms of conventional pneumatic ratchet drive wrenches are complex and require many parts interacting with one another. For instance, wrenches traditionally require complex mechanisms for ensuring that the output member of the wrench does not rotate counter the desired direction during wrench use. These mechanisms often include multiple parts that serve the limited purpose of inhibiting counter-rotation of the output member. Similarly, size and space limitations of the wrench often compel the fashioning of elaborate, interactive components. For example, a reverse lever must often be incorporated directly with a drive link of the wrench, requiring a larger and heavier drive link than required for performing the drive link function alone (e.g., U.S. Pat. No. 5,535,646). Simplification of such a wrench by eliminating redundant parts and reducing the size and complexity of required parts improves overall wrench design.

It is an aim of wrench manufacturers to provide a pneumatic ratchet drive wrench that uses energy efficiently and incorporates fewer and simpler components. One difficulty in the fashioning of such a wrench is providing an output member that may rotate in both directions, yet will not rotate opposite the desired direction between subsequent pawl engagements. Typically, wrenches include anvil pressure washers for impeding counter-rotation of the output member. Other configurations incorporate stop mechanisms of increased complexity and cost. It is therefore the aim of the present invention to provide a stop mechanism that is inexpensive to manufacture and simple to incorporate into another spring of the invention. It is also the aim of the present invention to provide a wrench that manages wear more efficiently by decreasing wear of expensive or difficult to replace components, while transferring the wear to more easily replaceable and inexpensive components.

SUMMARY OF THE INVENTION

Among the several objects and features of the present invention may be noted the provision of a pneumatic ratchet drive wrench which reduces the number and complexity of wrench components; the provision of such a wrench which decreases the wear exhibited on expensive or difficult to replace components; the provision of such a wrench which allows for a smaller overall wrench size for access into small spaces; the provision of such a wrench which allows for more relaxed tolerances for wrench components; and the provision of such a wrench which may be manufactured inexpensively.

Generally, a pneumatic ratchet drive wrench of the present invention comprises a housing. An air inlet is supported by the housing. The inlet is sized and shaped for connection to a source of pressurized air. An air motor is disposed in the housing and is in fluid communication with the air inlet for receiving pressurized air. The motor includes a rotatable drive shaft that rotates when pressurized air passes through the motor. A rocker is disposed pivotably within the housing and is operatively connected to the drive shaft so that rotation of the drive shaft induces oscillation of the rocker. At least one pawl is pivotably attached to the rocker. An output member has teeth and is mounted in the housing for rotation about its longitudinal axis. The output member projects from the housing for transmitting torque to an object. The at least one pawl is shaped and sized for engagement with the output member teeth to turn the output member. At least one spring is supported in the housing for biasing the at least one pawl against the teeth. The at least one spring is shaped and sized for restraining the output member from rotation opposite the rotation induced by the pawl.

In another aspect of the present invention, a pneumatic ratchet drive wrench comprises a housing, an air inlet, an air motor and a rocker generally as set forth above. The wrench further comprises at least two pawls pivotably attached to the rocker and an output member having teeth. The output member is mounted in the housing for rotation about its longitudinal axis and projects from the housing for transmitting torque to an object. The pawls are shaped and sized for alternate engagement with the output member teeth to turn the output member. At least one spring is supported in the housing for biasing at least one of the at least two pawls against the teeth. The at least one spring is shaped and sized for restraining the output member from rotation opposite the rotation induced by the at least one pawl. The spring includes a pawl-engaging portion, engaging the pawl and biasing the pawl against the teeth, a stop portion, engagable with the teeth to restrain the output member from rotation in a direction opposite that induced by the pawi, and a coil portion, formed to independently bias the pawl-engaging portion and the stop portion. The coil portion comprises a pawl coil for biasing the pawl-engaging portion and a stop coil for biasing the stop portion. The stop portion and teeth are shaped and arranged in the housing so that upon rotation of the output member in the direction induced by the pawl, the teeth push the stop portion outwardly from the output member to permit rotation. Upon rotation of the output member in the opposite direction, the stop portion engages the teeth to block the opposite rotation.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
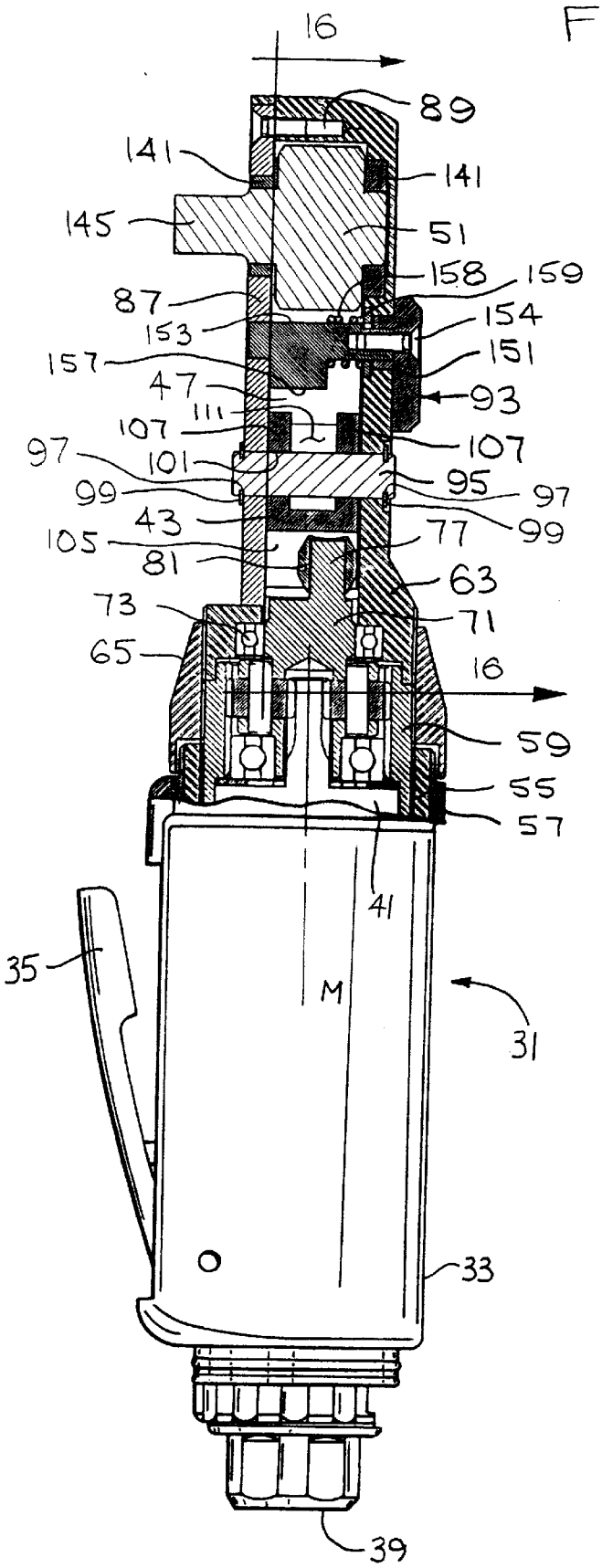
FIG. 1 is a right side, partial section of a pneumatic ratchet drive wrench of the present invention.

Referring now to the drawings and particularly to FIG. 1, reference number 31 generally indicates a pneumatic ratchet drive wrench of the present invention. Generally, the wrench 31 includes a housing 33, a trigger 35, an air inlet 39, an air motor 41, a rocker 43, at least two pawls 47, an output member 51 and springs 53. Each of these will be discussed in greater detail below. The wrench housing 33 includes a motor casing 55, a grip 57 overlying the motor casing, a bearing collar 59 received within the motor casing, a head portion 63 seated on the collar, and an annular compression nut 65 encircling the motor casing and head portion for holding the housing together. The housing 33 supports the air inlet 39, which is sized and shaped for connection to a source of pressurized air. Air inlets compatible with the present invention are well known in the relevant art. The grip 57 is preferably formed from a soft material, such as rubber, to facilitate wrench 31 grip and cushioning.

The housing 33 supports the air motor 41, which connects to the air inlet 39 for receiving pressurized air. Air motors 41 are well known in the art and operate to translate the energy of pressurized air into the rotational motion of a drive shaft 71. A bearing 73 inserted in the wrench 31 allows the drive shaft 71 of the air motor 41 to rotate within the wrench 31. The drive shaft 71 has an eccentric projection 77 extending from the distal end of the shaft. The projection 77 is offset from the rotational axis of the shaft 71, so that viewed from the front, rotation of the shaft causes the projection to move laterally side-to-side (see FIGS. 16–19). The projection 77 further includes a rotatable bushing 81 that rotates freely upon a vertical axis the projection. The bushing 81 acts as an interface between the projection 77 and the rocker 43, ensuring smooth movement between the rocker and drive shaft 71, as discussed in greater detail below.

The wrench 31 additionally includes an access plate 87 mounted on the head portion 63. Removing the access plate 87 provides access to the wrench interior. Bolts 89 secure the access plate 87 to the head portion 63 of the wrench 31. A reversing switch, generally indicated 93 and discussed in greater detail below, mounts on the head portion 63 and extends through the housing 33 and access plate 87. The output member 51 and a rocker pivot 95, discussed below, additionally extend through the access plate 87.

Figure 2:
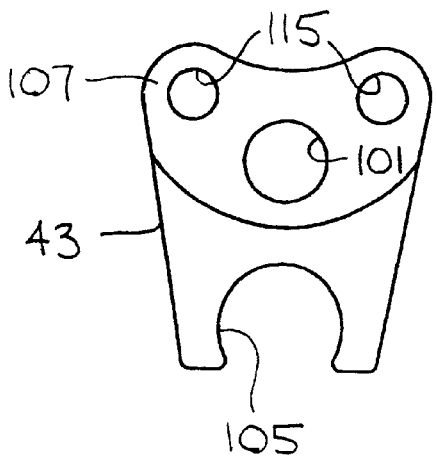
FIG. 2 is a front elevation of a rocker.
Figure 3:
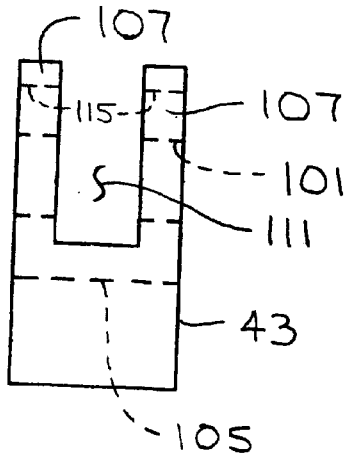
FIG. 3 is a side elevation of the rocker.

The housing 33 supports the rocker 43 for pivoting movement about the rocker pivot 95. The rocker pivot is a shaft passing through the head portion 63, the access plate 87 and a rocker pivot hole 101. The rocker pivot 95 includes a circumferential groove 97 at either end of the pivot 95, each groove capable of receiving a snap ring 99. The snap rings capture the pivot 95 between the head portion 63 and access plate 87, thereby holding the pivot in the proper position. The rocker 43, pivoting freely about the rocker pivot 95, transforms the rotational energy of the air motor 41 to a pivoting motion. FIGS. 2 and 3 show the details of the rocker 43 of the present invention. The rocker 43 includes a recess 105 for receiving the bushing 81 of the drive shaft 71 so that rotation of the drive shaft induces oscillation of the rocker. The rocker 43 further includes opposing flanges 107 defining a cavity 111 for receiving a pair of pawls 47. Each flange 107 includes a pair of pawl holes 115 for receiving pawl pins 117, about which the pawls 47 may pivot within the cavity 111. As the rocker 43 pivots, the pawls 47 oscillate up and down and pivot on the pawl pins 117.

Figure 4:
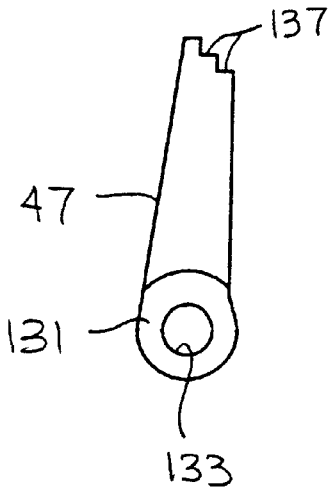
FIG. 4 is a front elevation of a reversing pawl.
Figure 5:
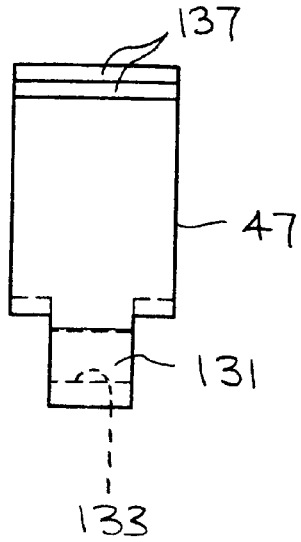
FIG. 5 is a right side elevation of the reversing pawl.

Referring now to FIGS. 4 and 5, a pawl 47 of the present invention is shown. The wrench 31 preferably includes two pawls 47 (although more or less pawls may be substituted without departing from the scope of the invention) pivotably attached to the rocker 43 as described above. The pawls 47 are shaped and sized for engagement with teeth 121 of the output member 51 to turn the output member. In the illustrated embodiment, each wrench 31 includes two pawls 47, including a forwarding pawl 125 and a reversing pawl 127. The forwarding pawl and reversing pawl are identical to one another and fit between the flanges 107 on either side of the rocker 43. Each pawl 47 includes a central cylindrical hub 131 having a horizontal passage 133 for receiving a pawl pin 117 for attachment to the rocker 43. Each pawl 47 extends upward from the hub 131 and ends with a plurality of inwardly facing steps 137 sized and shaped for engaging the teeth 121 of the output member 51 and rotating the output member in a particular direction, as will be discussed below. Because the pawls 47 extend generally parallel to one another, as opposed to crossing each other as with prior art configurations, they contain no voids, allowing them to be smaller than conventional pawls, without sacrificing strength. Beyond the hub 131, which must be narrow enough to fit between the flanges 107, the depth of the pawl 47 increases, corresponding to the internal depth of the wrench 31.

Figure 8:
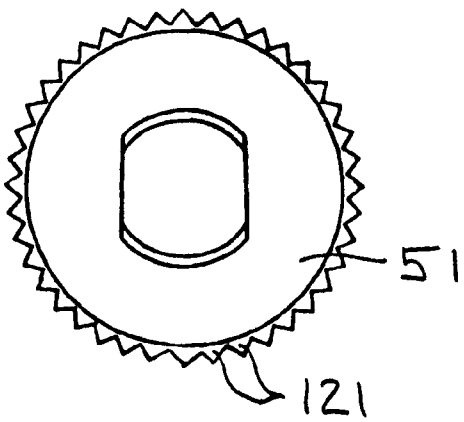
FIG. 8 is a rear elevation of the output member.
Figure 6:
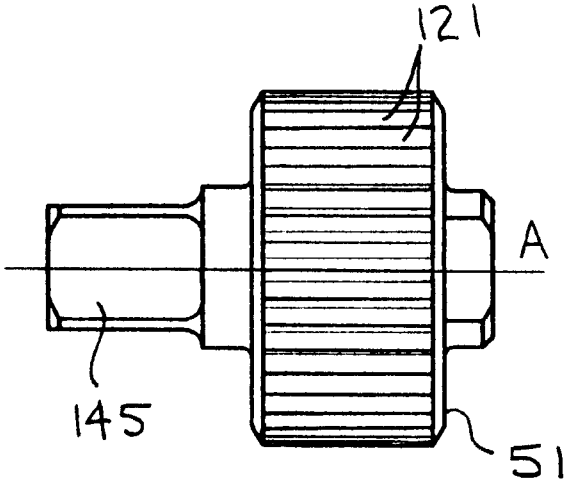
FIG. 6 is a right side elevation of an output member.
Figure 7:
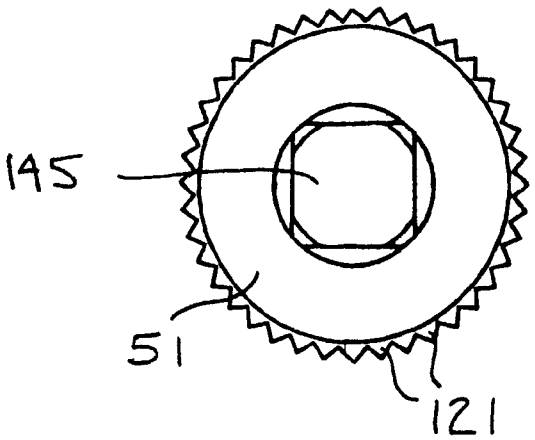
FIG. 7 is a front elevation of the output member.
Figure 10:
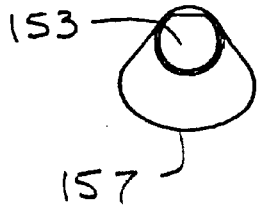
FIG. 10 is a rear elevation of the reversing switch.
Figure 9:
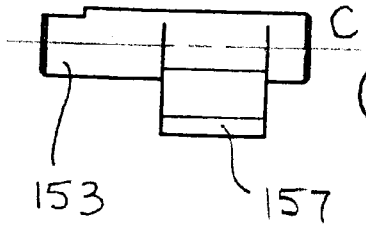
FIG. 9 is a left side elevation of a reversing switch.
Figure 11:
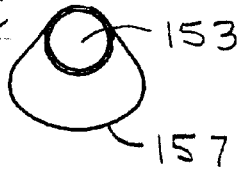
FIG. 11 is a front elevation of the reversing switch.
Figure 13:
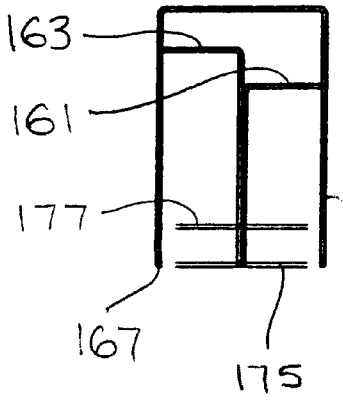
FIG. 13 is a left side elevation of the reversing spring.
Figure 12:
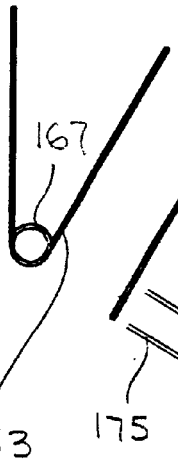
FIG. 12 is a front elevation of a reversing spring.
Figure 14:
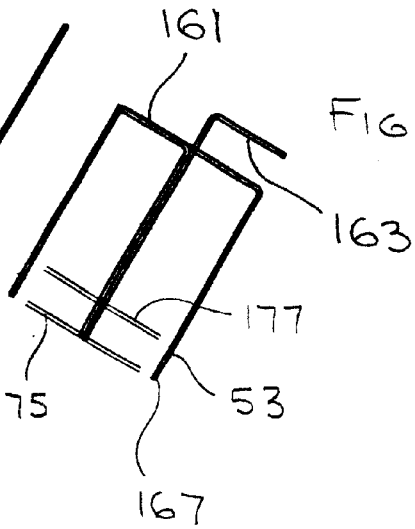
FIG. 14 is a right side elevation of the reversing spring.
Figure 15:
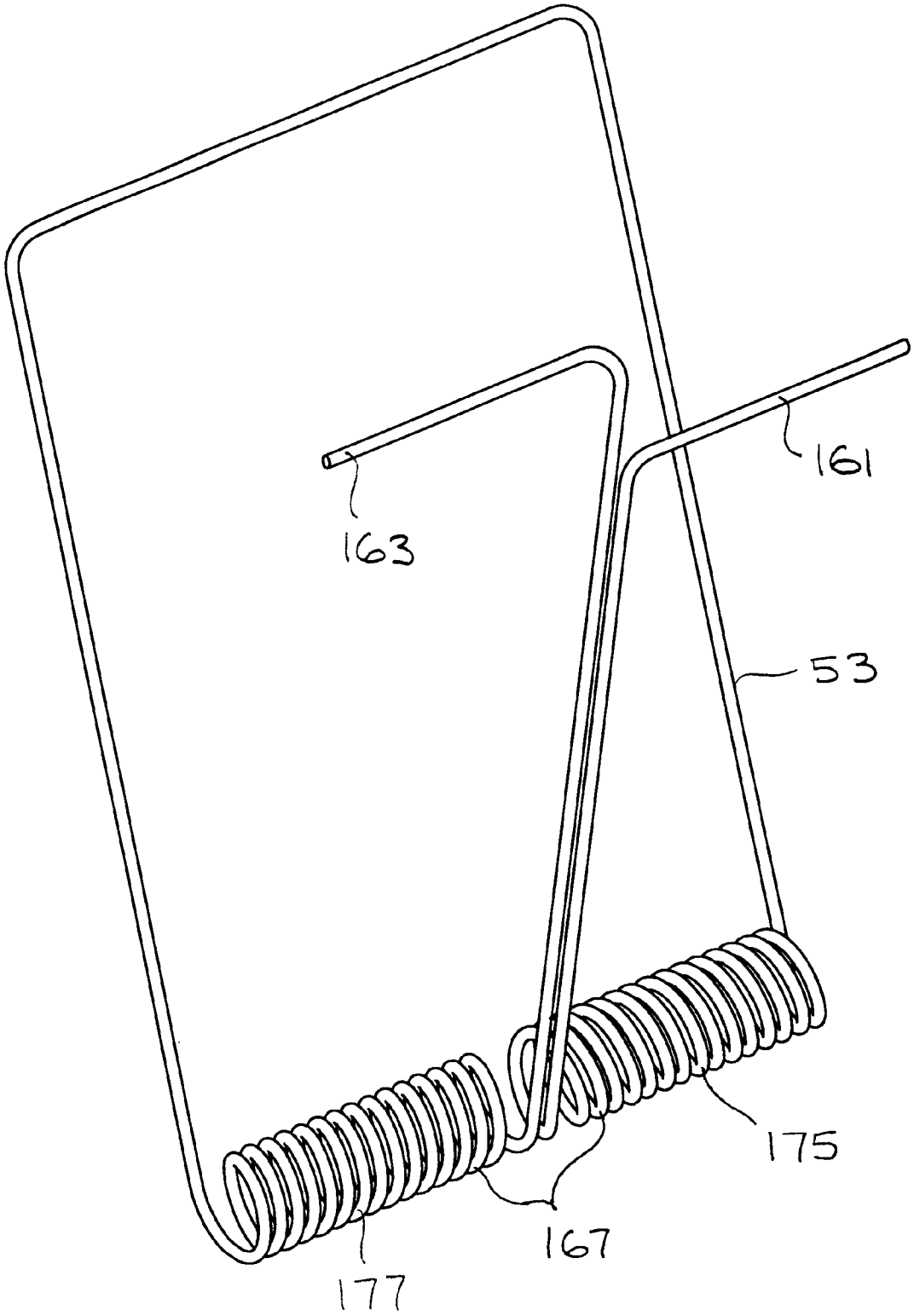
FIG. 15 is a perspective of the reversing spring.

FIGS. 6–8 depict the output member 51 of the wrench 31. Teeth 121 arranged about the perimeter of the output member 51 are generally parallel to the longitudinal axis A of the output member. The housing 33 supports the output member 51 for free rotation about its longitudinal axis. Opposing annular bushings 141 (FIG. 1) are disposed in the wrench head between the output member 51 and the head portion 63 and access plate 87. These bushings 141 properly align and position the output member 51 within the wrench 31, acting as a removable wear surface for the output member. Unlike many conventional wrenches, the present configuration does not include a pressure washer between the member 51 and the housing 33 to inhibit the free rotation of the output member within the housing. By allowing free rotation of the output member 51, the power required to rotate the output member and the heat from friction due to rotation are both reduced. Without the pressure washer, the wrench 51 must inhibit counter-rotation of the output member 51 in another manner, as discussed below. The member 51 additionally projects from the housing 33 for transmitting torque to an object (FIG. 1). The output member 51 further includes a male socket fitting 145 extending from the member for mating with a socket or other tool (not shown).

Turning to FIGS. 1 and 9–11, the reversing switch for reversing the rotational direction of the output member 51 is generally indicated at 93, for selectively changing the wrench 31 rotational direction. A knob 151 receives a rear end of a cam shaft 153 of the reversing switch 93. A screw 154 holds the knob 151 and cam shaft 153 in fixed relation to one another. The cam shaft 153 pivots within the housing 33 about a pivoting axis C between a forward position and a reverse position. The reversing switch 93 further comprises a cam surface 157 extending from the cam shaft 153. A coil spring 158 disposed within the housing 33 receives the cam shaft 153 for biasing the cam surface 157 against the access plate 87. A front end of the spring 158 reacts against the cam surface 157 while a rear end of the spring reacts against a washer 159 seated in the head portion 63 of the tool. The spring 158 allows the reversing switch 93 to move along its axis slightly, so that a protuberance (not shown) of the head portion 63 engages the knob 151 when in-between the forward and reverse positions. This interference helps urge the reversing switch 93 into either the forward or reverse position. Depending upon the position of the reversing switch 93, the cam surface 157 is offset from the pivoting axis C of the reversing switch 93 for biasing either the forwarding or reversing pawl 125,127 away from and out of engagement with the output member 51. The reversing switch 93 limits movement of one pawl 47 by engaging the pawl to overcome the spring-induced bias of the pawl and prevent engagement with the output member 51. Pivoting the switch 93 to the forward position engages the cam surface 157 with the reversing pawl 127 and biases the reversing pawl away from the teeth 121 of the output member 51. Alternately, pivoting the switch 93 to the reverse position engages the cam surface 157 with a forwarding pawl 125 and biases the forwarding pawl away from the teeth 121 of the output member 51.

The reversing switch 93 does not mount on or engage the rocker 43, so the rocker may be smaller than is typical, which must normally include an opening for receiving the reversing switch. The configuration of the present invention allows for a more compact rocker 43, specifically having a narrower profile, while retaining the strength characteristics of a more traditional rocker.

FIGS. 12–15 disclose details of the springs 53 supported in the housing 33 for biasing the pawls 47 toward the teeth 121 and restraining the output member 51 from rotation opposite that induced by the pawl. The other of the springs 53 is identical to the one shown, and therefore a description of one suffices for both. The spring 53 includes a pawl-engaging portion 161 for engaging a corresponding pawl 47 and biasing the pawl toward the teeth 121. A stop portion 163 of the spring 53 engages the teeth 121 and restrains the output member 51 from counter-rotation in a direction opposite that induced by the pawl 47. The spring 53 further includes a coil portion 167 that biases the pawl-engaging portion 161 and the stop portion 163 independently. A spring post 171 (FIG. 16) mounted within the housing 33 passes through the spring coil portion 167 to locate the spring 53 within the wrench. The coil portion 167 further includes a pawl coil 175 for biasing the pawl-engaging portion 161 and a stop coil 177 for independently biasing the stop portion 163. These portions 161,163 function independently, although both spring portions and coil portions 175,177 are formed as one piece of spring wire in the preferred embodiment. The pawl-engaging portion 161 and stop portion 163 extend generally parallel to one another from the pawl coil 175 and stop coil 177, respectively. Both the pawl-engaging portion 161 and stop portion 163 are generally L-shaped, and the stop portion 163 extends beyond the pawl-engaging portion 161 to engage the output member 51. Each wrench 31 has two springs 53, including a forwarding spring 181, for engaging the forwarding pawl 125, and a reversing spring 183, for engaging the reversing pawl 127.

The stop portions 163 of the springs 53 and the teeth 121 of the output member 51 are shaped and arranged in the housing 33 so that upon rotation of the output member in the direction induced by the corresponding pawl 47, the teeth push the stop portion of each spring outwardly from the output member. This permits rotation in one direction only, so that upon rotation of the output member 51 in the opposite direction, the stop portion 163 engages the teeth 121 and inhibits counter-rotation. The stop portion 163 engages the teeth 121 of the output member 51 at an angle that encourages the stop portion to wedge against the output member when subjected to counter-rotative forces. These forces are opposed by the portion stop 163 to block counter-rotation of the output member 51. Thus, the stop portion 163 is rigid enough to inhibit counter-rotation, while discouraging excessive wear of the output member 51.

In operation, the wrench 31 provides controlled torque output to a socket or similar tool attached to the output member 51. FIGS. 16–19 depict the operation of the wrench 31 at various stages throughout a single air motor 41 rotation. Once the source of pressurized air connects to the wrench 31, depressing the trigger 35 permits airflow through the motor 41. The detailed construction of the motor 41 and air inlet 39 will not be discussed here, as one skilled in the art would readily understand incorporating an air motor, trigger 35 and source of pressurized air to turn the air motor. Once the motor 41 turns, the drive shaft 71 turns and the projection 77 and bushing 81 alternate side-to-side, as viewed from the front of the wrench 31 seen in FIGS. 16–19. In fact, the drive shaft 71 rotates and the offset projection 77 moves in a circular motion about the motor axis M. Because of the rocker pivot 95, however, the motion of the rocker 43 is side-to-side only, moving the pawls 47 alternately upward and downward with respect to the springs 53 and the housing 33.

Figures 16, 17, 18, 19:
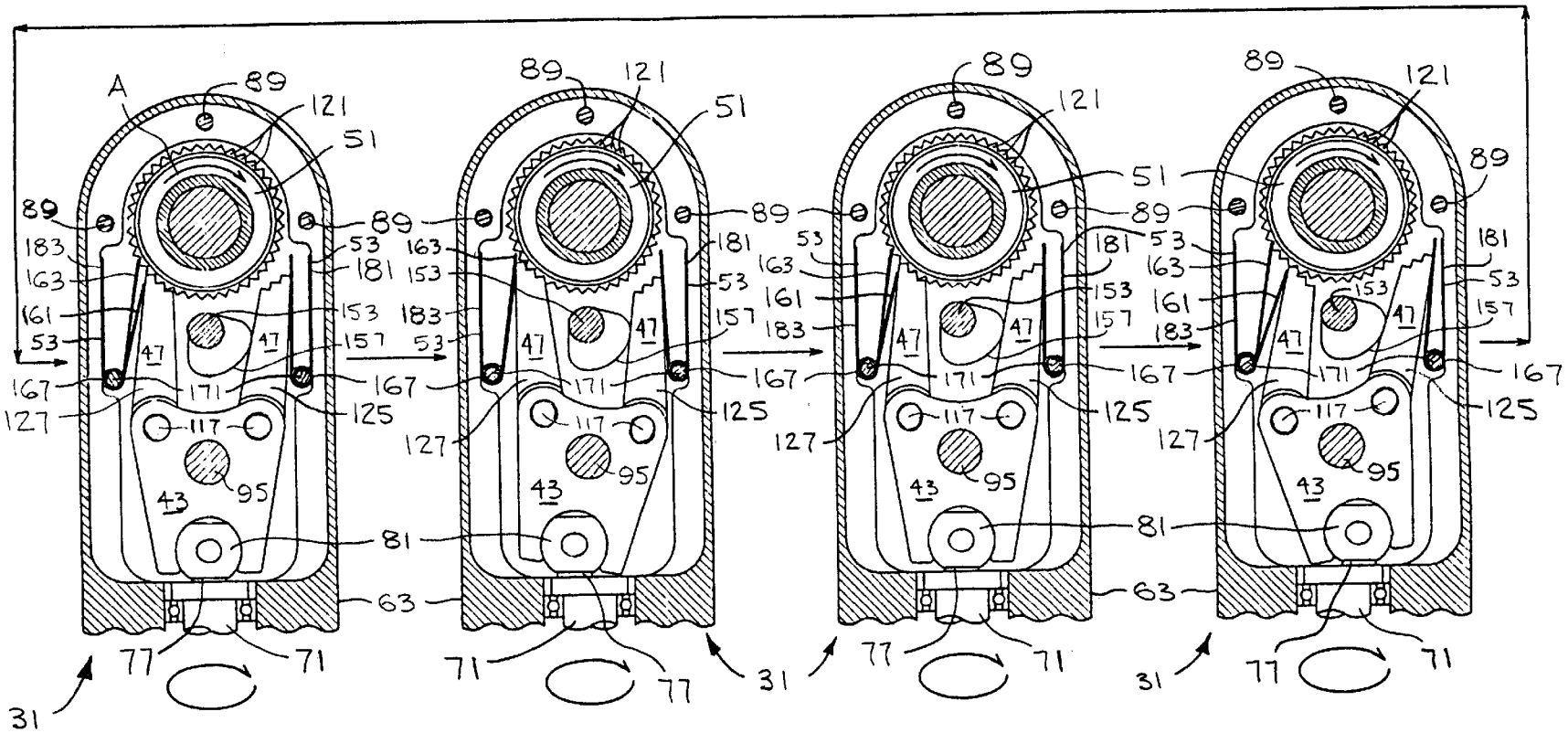
FIG. 16 is a partial front section taken in a plane including 16—16 of FIG. 1 with the reversing pawl shown midway through its driving stroke positioned against the drive shaft.
FIG. 17 is the section of FIG. 16 with the reversing pawl shown in its fully-extended position against the drive shaft.
FIG. 18 is the section of FIG. 16 with the reversing pawl shown midway through its return stroke as it returns toward the start of another driving stroke.
FIG. 19 is the section of FIG. 16 with the reversing pawl shown in its initial position seated against the drive shaft.

Turning to FIG. 16, the wrench 31 depicted is midway through its driving stroke, with a reversing pawl 127 positioned against the output member 51. Arrow A indicates the rotational direction of the output member 51. The rocker 43 is at its neutral position, with both pawl pins 117 equidistant from the output member 51. The pawl-engaging portion 161 of the reversing spring 183 engages the reversing pawl 127, biasing the reversing pawl into engagement with the output member 51. The stop portion 163 of the reversing spring 183 engages the output member 51 and inhibits rotation of the output member in a direction opposite of that induced by the reversing pawl 127. With the reversing switch 93 (FIG. 1) pivoted to a reverse position, the cam surface 157 engages the forwarding pawl 125 and biases the forwarding pawl away from the output member teeth 121. By engaging the pawl 127, the cam surface 157 also biases the stop portion 163 of the forwarding spring 181 away from engagement with the output member 51. The pawl-engaging portion 161 and stop portion 163 of the forwarding spring 181 continue to engage the forwarding pawl 125, thereby inhibiting the pawl from rattling against the cam surface 157 during wrench operation. As the projection 77 and bushing 81 move leftward, the rocker 43 pivots leftward, urging the reversing pawl 127 upward against the output member 51 to drive rotation of the member in a reverse direction.

FIG. 17 depicts the wrench 31 at the end of its driving stroke, with the reversing pawl 127 in its fully-extended position against the output member 51. Here the reversing pawl 127 engages and pushes the teeth 121, rotating the output member 51 to its single cycle limit. As the output member has turned in the reverse direction, the stop portion 163 has moved resiliently via torsional movement of the stop coil 177 to permit teeth 121 to pass the stop portion in the reverse direction. Note that the reversing pawl 127 touches the stop portion 163 of the reversing spring 183 and pushes it slightly away from the output member 51 at the top end of the stroke. The stop portion 163 remains between the teeth 121, however, poised to engage and hold the output member 51 should it begin counter-rotation after the reversing pawl 127 retracts. The cam surface 157 continues urging the forwarding pawl 125 away from contact with the output member 51. Here the projection 77 of the drive shaft 71 is in its leftmost position, fully urging the rocker 43 to the limits of its leftward motion.

Turning to FIG. 18, the rocker 43 is midway through its return stroke. The reversing pawl 127 has moved downward and inward from its fully-extended position to engage the next lower tooth of the output member 51 in anticipation of another driving stroke. The pawl-engaging portion 161 urges the reversing pawl 127 toward the output member 51, ensuring that the reversing pawl 127 engages the member during the return stroke so that the pawl is ready to engage and rotate the output member after the return stroke. Continuing to engage the forwarding pawl 125, the cam surface 157 restricts pawl movement so it remains sufficiently clear of the output member 51 during reverse output member rotation.

FIG. 19 depicts the wrench 31 at the end of its return stroke. The rocker 43 has pivoted to its rightmost position in which the distal end of the reversing pawl 127 has moved downward to its lowest position where it may engage yet another tooth of the output member 51. The pawl-engaging portion 161 continues to urge the reversing pawl 127 toward the output member 51, ensuring that the pawl fully engages the output member. Comparing FIGS. 17 and 19, depicting the reversing pawl 127 in its fully extended and fully retracted position, respectively, a single return stroke allows the pawl to reposition itself on the output member 51 two teeth 121 downward from its ending position. Each rotation of the air motor 41 rotates the output member 51 the equivalent of two tooth positions. For the preferred embodiment shown in the enclosed figures, the ratio of motor 41 rotations to output member 51 rotations is 20:1. By altering the size and shape of the various wrench components, other gear ratios could be achieved.

With the reversing switch 93 in the forward position (not shown), the wrench 31 performs exactly as set forth above, except in the forward direction. The cam surface 157 of the reversing switch 93 engages the reversing pawl 127 to inhibit engagement of the pawl with the output member 51. At the same time, the stop portion 163 of the reversing spring 183 is moved out of engagement with the output member 51. The forwarding spring 181 urges the forwarding pawl 125 inward to engage the output member 51 for rotation in the forward direction. The stop portion 163 of the forwarding spring 181 moves into engagement with the output member 51 to prevent counter-rotation in the reverse direction.

The wrench configuration shown in the enclosed figures may be altered without departing from the scope of the present invention. For instance, components may be formed from more than one portion of material without departing from the scope of the present invention. Moreover, dimensions and proportions of the disclosed elements or alternate materials may be substituted without departing from the scope of the present invention.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A pneumatic ratchet drive wrench, the wrench comprising:

a housing;

an air inlet supported by the housing, said inlet being sized and shaped for connection to a source of pressurized air;

an air motor disposed in the housing and in fluid communication with the air inlet for receiving pressurized air, said motor including a rotatable drive shaft that rotates when pressurized air passes through said motor;

a rocker disposed pivotably within the housing and operatively connected to the drive shaft so that rotation of the drive shaft induces oscillation of the rocker;

at least one pawl pivotably attached to the rocker;

an output member having teeth, the output member being mounted in the housing for rotation about its longitudinal axis and projecting from the housing for transmitting torque to an object, said pawl being shaped and sized for engagement with the output member teeth to turn the output member; and at least one spring supported in the housing for biasing said at least one pawl against the teeth, said at least one spring being shaped and sized for restraining the output member from rotation opposite the rotation induced by the pawl, wherein the spring includes a pawl-engaging portion engaging said pawl and biasing said pawl against the teeth and a stop portion engageable with the teeth to restrain the output member from rotation in a direction opposite that induced by the pawl.

2. A pneumatic ratchet drive wrench as set forth in claim 1 wherein the stop portion and teeth are shaped and arranged in the housing so that upon rotation of the output member in the direction induced by the pawl, the teeth push the stop portion outwardly from the output member to permit rotation and so that upon rotation of the output member in the opposite direction the stop portion engages the teeth to block said opposite rotation.

3. A pneumatic ratchet drive wrench as set forth in claim 2 wherein said spring further includes a coil portion formed to independently bias the pawl-engaging portion and the stop portion.

4. A pneumatic ratchet drive wrench as set forth in claim 3 wherein the coil portion comprises a pawl coil for biasing the pawl-engaging portion and a stop coil for biasing the stop portion.

5. A pneumatic ratchet drive wrench as set forth in claim 4 wherein the spring is formed as one piece of spring wire.

6. A pneumatic ratchet drive wrench as set forth in claim 3 wherein the pawl-engaging portion and stop portion extend generally parallel one another from the pawl coil and stop coil, respectively.

7. A pneumatic ratchet drive wrench as set forth in claim 6 wherein the pawl-engaging portion and stop portion are generally L-shaped.

8. A pneumatic ratchet drive wrench as set forth in claim 7 wherein the stop portion extends beyond the pawl-engaging portion.

9. A pneumatic ratchet drive wrench as set forth in claim 1 further comprising two of said pawls including a forwarding pawl and a reversing pawl; and two of said springs including a forwarding spring and a reversing spring.

10. A pneumatic ratchet drive wrench as set forth in claim 9 further comprising a reversing switch for reversing the rotational direction of the output member.

11. A pneumatic ratchet drive wrench as set forth in claim 10 wherein the reversing switch is disposed for selectively engaging at least one of said at least two pawls to overcome the bias of the spring on the pawl to prohibit engagement with said output member.

12. A pneumatic ratchet drive wrench as set forth in claim 11 wherein the reversing switch pivots within the housing about a pivoting axis, said reversing switch being pivotable between a forward position and a reverse position.

13. A pneumatic ratchet drive wrench as set forth in claim 12 wherein the reversing switch further comprises a cam surface extending from the switch, said cam being offset from the pivoting axis of the reversing switch, such that pivoting the switch to the forward position engages the reversing pawl and biases said reversing pawl away from said output member teeth, while pivoting the switch to the reverse position engages the forwarding pawl and biases said forwarding pawl away from said output member teeth.

14. A pneumatic ratchet drive wrench, the wrench comprising:

a housing;

an air inlet supported by the housing, said inlet being sized and shaped for connection to a source of pressurized air;

an air motor disposed in the housing and in fluid communication with the air inlet for receiving pressurized air, said motor including a rotatable drive shaft that rotates when pressurized air passes through said motor;

a rocker disposed pivotably within the housing and operatively connected to the drive shaft so that rotation of the drive shaft induces oscillation of the rocker;

at least two pawls pivotably attached to the rocker;

an output member having teeth, the output member being mounted in the housing for rotation about its longitudinal axis and projecting from the housing for transmitting torque to an object, said pawls being shaped and sized for alternate engagement with the output member teeth to turn the output member; and at least one spring supported in the housing for biasing at least one of said at least two pawls against the teeth, said at least one spring being shaped and sized for restraining the output member from rotation opposite the rotation induced by said at least one pawl, said spring includes a pawl-engaging portion engaging said pawl and biasing said pawl against the teeth, a stop portion engagable with the teeth to restrain the output member from rotation in a direction opposite that induced by the pawl, and a coil portion formed to independently bias the pawl-engaging portion and the stop portion, said coil portion comprises a pawl coil for biasing the pawl-engaging portion and a stop coil for biasing the stop portion, said stop portion and teeth are shaped and arranged in the housing so that upon rotation of the output member in the direction induced by the pawl the teeth push the stop portion outwardly from the output member to permit rotation and so that upon rotation of the output member in the opposite direction the stop portion engages the teeth to block said opposite rotation.

15. A pneumatic ratchet drive wrench as set forth in claim 14 wherein the spring is formed as one piece of spring wire.

16. A pneumatic ratchet drive wrench as set forth in claim 15 wherein the pawl-engaging portion and stop portion are generally L-shaped and extend generally parallel one another from the pawl coil and stop coil, respectively, wherein said stop portion extends beyond the pawl-engaging portion.

17. A pneumatic ratchet drive wrench as set forth in claim 16 further comprising a reversing switch for reversing the rotational direction of the output member.

18. A pneumatic ratchet drive wrench as set forth in claim 17 wherein the reversing switch is disposed for selectively engaging said at least one pawl to overcome the bias of the spring on the pawl to prohibit engagement with said output member.

19. A pneumatic ratchet drive wrench as set forth in claim 18 wherein the reversing switch pivots within the housing about a pivoting axis, said reversing switch being pivotable between a forward position and a reverse position.

* * * * *